US006276073B1

(12) United States Patent
Curley, Jr.

(10) Patent No.: US 6,276,073 B1
(45) Date of Patent: Aug. 21, 2001

(54) DYNAMIC PERMANENT SPIKE OUTSOLE

(76) Inventor: John J. Curley, Jr., P.O. Box 442, Tyngsboro, MA (US) 01879

( * ) Notice: Subject to any disclaimer, the term of this patent is extended or adjusted under 35 U.S.C. 154(b) by 0 days.

(21) Appl. No.: 09/440,527

(22) Filed: Nov. 15, 1999

Related U.S. Application Data

(60) Provisional application No. 60/111,152, filed on Dec. 4, 1998.

(51) Int. Cl.[7] ..... A43B 23/28

(52) U.S. Cl. ..... 36/59 C; 36/59 R; 36/127

(58) Field of Search ..... 36/59 R, 61, 67 R, 36/59 C, 127

(56) References Cited

U.S. PATENT DOCUMENTS

| | | | | |
|---|---|---|---|---|
| D. 390,693 | | 2/1998 | Curley | D2/962 |
| 988,527 | * | 4/1911 | Wiseman | 36/59 R |
| 4,375,728 | | 3/1983 | Dassler | 36/32 R |
| 4,404,759 | * | 9/1983 | Dassler | 36/59 C |
| 4,434,565 | * | 3/1984 | Haley | 36/59 R |
| 4,777,738 | | 10/1988 | Giese | 36/32 R |
| 5,259,129 | | 11/1993 | Deacon | 36/127 |
| 5,724,754 | * | 3/1998 | Kataoka et al. | 36/59 C |
| 5,768,802 | * | 6/1998 | Bramani | 36/59 C |
| 5,887,371 | | 3/1999 | Curley | 36/127 |
| 6,029,377 | * | 2/2000 | Niikura et al. | 36/59 R |

* cited by examiner

*Primary Examiner*—M. D. Patterson
(74) *Attorney, Agent, or Firm*—Bourque & Associates, P.A.

(57) ABSTRACT

A permanent spike dynamic outsole (10) having a plurality of traction sections (16*a*–16*f*) which have a plurality of dynamic traction elements (20) on their respective leading and trailing edges, under which are located debris channels (32*a*–32*e*) which act as a retraction areas for the dynamic elements (20) to go when walking on firm surfaces, thus reducing damage to greens and abrasion from pavement. The debris channels (32*a*–32*e*) additionally provide an exit path for any debris that may be caught under the dynamic traction elements (20).

16 Claims, 4 Drawing Sheets

DYNAMIC PERMANENT SPIKE OUTSOLE

BACKGROUND—CROSS-REFERENCES TO RELATED APPLICATIONS

This application claims the benefit of Provisional Patent Application Ser. No. 60/111,152, filed Dec. 4, 1998.

BACKGROUND—FIELD OF INVENTION

This invention relates to dynamic traction elements that are integrally molded within a shoe sole, becoming permanent, non-replaceable ground engaging traction elements.

BACKGROUND—DESCRIPTION OF PRIOR ART

Athletic shoe spikes used primarily in the sport of golfing have traditionally had a single ground engaging spike which extended downward from the spike base flange about 8 mm. Recently most golf courses have prohibited the use of these traditional golf spikes due to the damage they cause to golf courses and more particularly damage to golf course greens.

The response of golf spike manufacturers to the prohibition of traditional spikes has been to substitute the single 8 mm ground engaging spike with a series of small, approximately 2 mm high protrusions, positioned in typically circular patterns around a traditional spike base flange. (See U.S. Pat. No. 5,259,129). This method provides little ground engaging ability particularly on wet surfaces.

U.S Pat. No. 4,375,728 seems to show at first glance, dynamic traction elements. However, these are used to do away with foam type cushioning midsoles. The patent teaches that the plurality of flexible nubs are used for cushioning purposes as well as for support. There are several flaws with this patent. First, if these flexible nubs were used on a delicate surface such as a golf green there is no cavity for which the flexible nubs can flex into and thus not case a waffling pattern on the green. Second, it appears as illustrated that the design cannot be put into practice as there would be an undercut for each grouping of flexible nubs and therefore impossible to mold as a unit.

U.S. Pat. No. 4,777,738 is one of many patents that claim advantages over prior art in the shape or configuration of fixed nubs or patterns on an outsole surface claiming improved traction. The disadvantage to this invention and others like it is in the fact that the traction elements are not dynamic, thus susceptible to the drawbacks mentioned in this application.

(For the sake of simplicity, throughout this text I will refer to all types of fixed static protrusions on alternative spikes whether they are rings, dimples or nubs as "nubs." Dynamic protrusions that have the ability to flex both up and down will be referred to as "traction elements.")

Furthermore, traditionally, these spikes are threaded into a receptacle in the shoe outsole. With the introduction of these various types of non-penetrating spikes with nubbed or dynamic elements, there is a greater tendency for these types of spikes to back out of threaded receptacles than is the case for the penetrating spike designs. It is the plurality of nubs placed along the perimeter of the flange like disk which causes these spikes to be susceptible to the rotational forces or "reverse torque" which acts on the spike during a sports activity such as a golf swing.

During a typical golf swing a golfer will pivot both golf shoes while swinging. This pivoting action applies a common type of force to the spikes know as lateral shear. With one single spike per flange as was the case with traditional metal spikes, this lateral shear had little affect on the tensile stress locking means, which is the bases of all threaded devices. The newer type of spikes have a plurality of smaller nubs spaced away from the center axis of the threads. Lateral shear force acting on the nubs in this configuration, applies a torque effect on the spike. If the torque effect is to back the spike out of the threads, we refer to this action as reverse torque. By tensile stress locking we mean that once a thread is tightened it stretches the thread post slightly. This puts both the spike thread and receptacle thread under tensile stress. A combination of tensile stress and friction prevents the thread from backing out. Actually, the design of the traditional spike is an efficient design in terms of shedding torsional loads. The further out the placement of the nubs or traction elements are from the center axis of the spike and the increase in plurality of nubs, the more susceptible the spike is to the aforementioned lateral shear, known as torque or reverse torque. This is further demonstrated by the typical and long used means for applying torque to tighten traditional as well as alternative spikes. This method uses two pins on a spike wrench which grab the spike flange or nub disk close to the outside perimeter of the flange or disk, allowing the user to apply torque to tighten the spike. In the case of the traditional single spike designs, the amount of torque applied usually was sufficient to exceed the reverse torque forces encountered during use. In the case of the newer alternative spike designs, not enough torque can be applied to maintain the tensile stress locking of the spike into the threaded receptacles. Sooner or later the reverse torque acting on the spike during use will exceed the torque used to tighten the spike, eventually loosening the spike. Spikes directly under the pivot area of an outsole will usually loosen before spikes not located in the typical pivot areas on an outsole.

Additionally, these non-penetrating spikes have lower profiles and are suitably shaped to allow them to be molded out of the same material as a rubber outsole.

In response to the aforementioned problem of loose spikes and the suitability for the small nubs to be directly molded into rubber outsoles, manufacturers of golf footwear have been moving towards what is referred to as permanent spikes. This means that the ground engaging elements, usually small nubs on the bottom of a golf shoe outsole are molded directly onto the outsole surface and are not replaceable. The downside to permanent spikes is that once abrasion, which results from ground friction, wears down the permanent nubs, the golf shoe becomes useless as it will loose its traction characteristics.

An additional advantage for the shoe manufacturer of using only permanent spikes rather than replaceable spikes is the ability to do away with receptacles. This reduces costs and allows for more options in the design and material choices of midsoles. Furthermore, golf outsoles without receptacles generally weigh less than outsoles with receptacles.

There are at this time, numerous permanent alternative spike shoes on the market, along with numerous versions of shoes with a combination of permanent spikes and replaceable spikes. These golf shoes with numerous permanent spikes sometimes leave behind, particularly on wet greens, marks referred to as waffle patterns. These waffle patterns are disruptive to golfers as they can redirect the trajectory of putted golf balls.

In summary, first there were for many years traditional 8 mm long single post metal spikes. Each time these spikes penetrated a golf green they would compact the turf, immediately around the hole that the spike made. During a normal week of golf, millions of holes were made in every green. This caused serious compaction problems and resulted in increased maintenance costs. Additionally, the spike marks also reduced the ability to have true trajectories for golf balls rolling on greens.

Then came the typical alternative spike which eliminated the compaction problems of greens and also significantly reduced the problems of spike mark altered ball trajectories. With this change came the problems of loose spikes caused by the aforementioned design criteria. Furthermore, because of the poor abrasion characteristics of molded thermal plastics, which most alternative fixed nubbed spikes are made from, and along with the size and location of the nubs, premature wear caused by typically encountered friction has become a serious problem for golfers.

The current trend to solving these problems is to use numerous permanent alternative type spike nubs molded directly to the outsole or a combination of permanent and a reduced number of replaceable alternative spikes. These solution have reduced the amount of spike loss simply by reducing the amount of replaceable spikes used. Traction has improved as well due to the fact that typically on permanent types of alternative and combinations of permanent and replaceable alternative spike outsoles more nubs can be used. This helps improve traction between the shoe and the terrain. However, The permanent integrally molded rubber nub spikes are configured substantially the same as the replaceable nub spikes, therefore, premature wear is still a problem. This problem is exacerbated by the fact that these nubs are not replaceable.

As a result, along with this latest solution comes two problems. First the spikes cannot be replaced as is the case of an outsole with all permanent spikes. This will cause the shoes to become useless once the nubs wear down from abrasion with cart paths and pavement. Second the amount of fixed nubs on the permanent and combination permanent/replaceable shoes leave behind waffle patterns which reduce the quality of play on golf greens.

OBJECTS AND ADVANTAGES

It is the object of the present invention to provide a type of permanent alternative spike golf shoe outsole which addresses the problems described above, by using resilient dynamic traction type elements molded permanently to an outsole thereby reducing the tendency for the traction elements to wear out quickly. The dynamic aspect of these elements, that is, the ability of the traction elements to flex both up and down as needed, means that on hard surfaces such as gravel, cart paths and paved areas, the traction elements will flex upward into the shoe thus reducing friction. Reducing friction will result in reduced wear on the traction elements resulting in a longer useful life.

It is also an object of the present invention to provide a type of permanent alternative spike, golf shoe outsole that addresses the problems of waffling wet greens. The dynamic aspect of these elements allow them to flex upward in the dense relatively flat surface of golf greens, thus eliminating waffle patterns on wet greens. The traction elements will flex downward on less dense grasses found on fairways and roughs and provide improved traction for the golfer. It has been shown on currently marketed dynamic spikes such as that shown in U.S. Pat. No. Des 690,393 that once lateral slipping starts on a golf course the dynamic elements entangle within the turf and are forced downward, thus gripping the turf. Lateral slipping rarely occurs on the relative flat surfaces of golf greens, therefore typically the traction elements are not pulled downward, thus the golf shoe outsole surface presented to a golf green using only permanent dynamic type traction elements is relatively flat and will not leave behind waffle patterns.

It is a further object of the present invention is to provide a type of permanent alternative spike golf shoe outsole which reduces the tendency for grass and other natural types of debris, typically found on golf courses, to build up on the outsole and cause discomfort to the golfer. Debris buildup may also spread unwanted seeds from rough areas to groomed areas such as greens. It has further been shown on currently marketed dynamic spikes such as that shown in U.S. Pat. No. Des 690,393 that the dynamic aspect of the elements help prevent debris build up as the traction elements are constantly moving and thus generating a self cleaning action.

REFERENCE NUMERALS IN DRAWINGS

Figure 1:
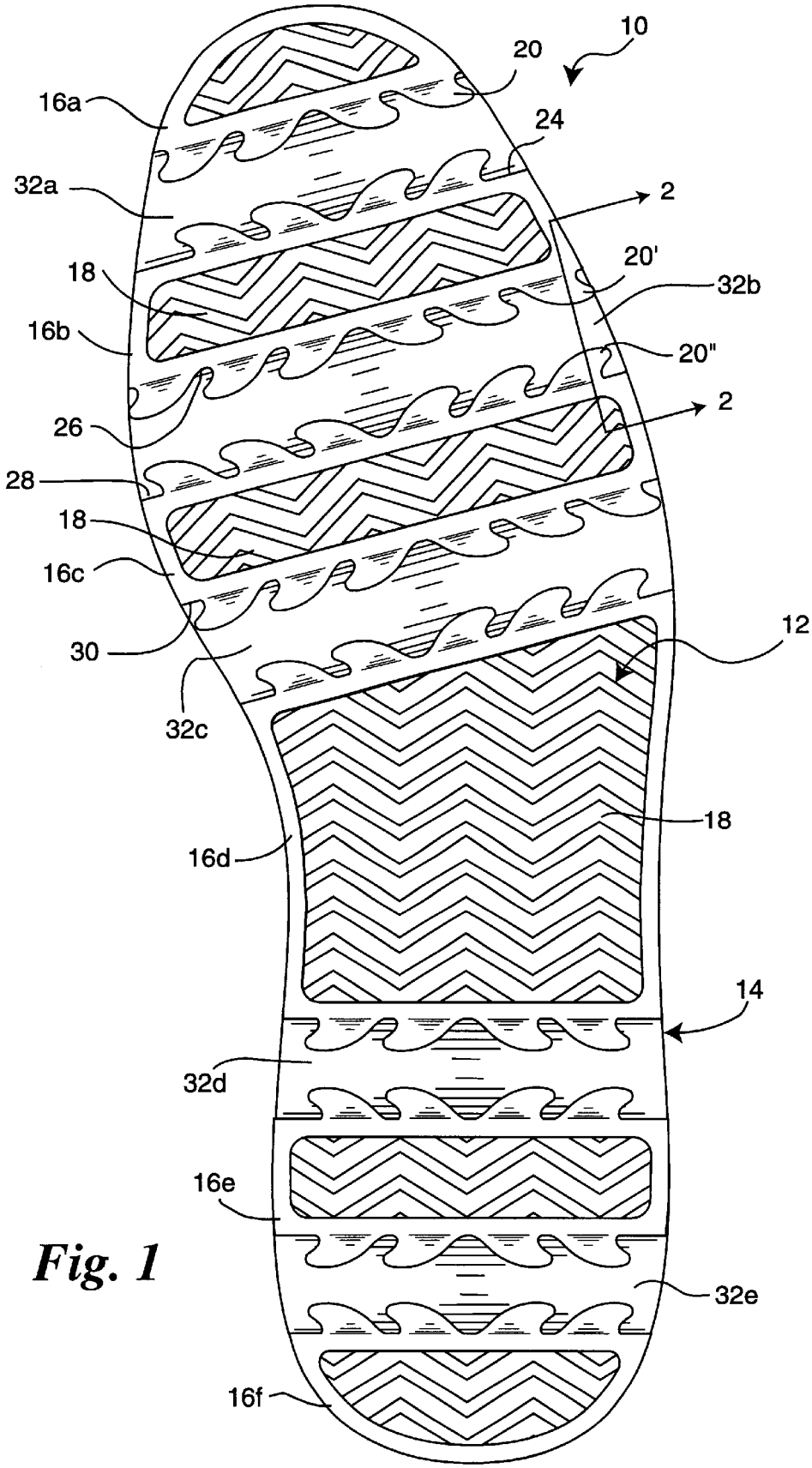
FIG. 1 is a plan view of the underside of an athletic shoe incorporating a first preferred embodiment of the present invention, permanent dynamic spike outsole.

| | |
|---|---|
| 10 | Outsole |
| 12 | Outsole bottom surface |
| 14 | Midsole |
| 16a–16f | Traction sections |

-continued

| | |
|---|---|
| 18 | Traction section center area |
| 20 | Dynamic traction elements |
| 24 | Traction section leading edge |
| 26 | Traction section trailing edge |
| 28 | Traction section leading edge |
| 30 | Traction section trailing edge |
| 32a–32e | Debris channels |
| 34 | Dense walking surface |
| 36 | Grass surface |
| 38 | Grass base |
| 40 | Directional arrow |
| 42 | Outsole |
| 44 | Outsole bottom surface |
| 46a–46g | Traction sections |
| 48 | Dynamic traction elements |
| 49 | Smooth plastic surface |
| 50 | Midsole |
| 52a–52c | Debris channels |
| 54 | Traction section leading edge |
| 56 | Traction section trailing edge |

SUMMARY

In accordance with the present invention an outsole comprising a plurality of traction surfaces comprised of a plurality of dynamic traction elements that flex both upward and into the golf outsole for reduced wear and for reduced waffling of greens, as well as flexing downward for providing enhanced traction as well as having beneath such traction elements, debris channels for which debris such as grass pieces can migrate outward and thus out of the outsole.

DESCRIPTION OF THE PREFERRED EMBODIMENTS

In accordance with the present invention, traction is provided for athletic activities on turf surfaces such as golf and soccer by providing an athletic shoe which a plurality of dynamic elements. The dynamic elements have the ability to flex upward when walking on firm or dense surfaces such as pavement, cart paths and golf greens, while at the same time having the ability to entangle within less dense material, such as normally groomed turf commonly found on soccer fields and golf course fairways. Thus entangled, they flex downward or extend downward and engage the turf and prevent slipping. Typically, for example, a plurality of traction elements are molded integrally within a rubber outsole. Therefore in place of a plurality of integrally molded rubber nubs typically found on so called permanent spike golf outsole, the present invention incorporates a plurality of resilient dynamic traction elements. The dynamic elements typically number 45 to 60 per outsole but could number as few as 25 or as many as 100.

The traction elements of the present invention do not readily wear out from abrasion forces which result from contact with abrasive surfaces such as pavement or gravel cart paths, because the dynamic flexing attributes of the traction elements allow them to flex upward into protective recesses within the outsole, and away from the abrasive forces. Therefore the traction elements are less susceptible to wearing out from abrasion than fixed nubs which have to bear the weight of the wearer and also directly bear the brunt of the abrasive forces which act on athletic outsoles.

The protective recesses or debris channels of the present invention provide a duel service. First they provide a protective recess for the traction elements to flex into and secondly any debris such as grass clipping that otherwise may clog the traction elements will go into these recesses or channels and work there way free in a lateral manner out of the outsole.

The present invention will now be described with reference to the drawings.

Referring to FIG. 1 outsole 10 shows outsole bottom surface 12 with six traction sections 16*a* through 16*f* which contain a plurality of resilient dynamic elements are which typically made of vulcanized rubber. The traction sections 16*a* through 16*f* are fixed to midsole 14 using typical adhesion means such as polyurethane adhesive. Within midsole 14 are debris channels 32*a* through 32*e*. Midsole 14 is an athletic shoe midsole which would typically be made of blown urethane foam or ethyl vinyl acetate (EVA) foam. Debris channels 32*a* through 32*e* lie between the leading and trailing edges of traction sections 16*a* though 16*f*. For clarity purposes in describing the first embodiment of the present invention I will limit the description to traction sections 16*b* and 16*c* and debris channel 32*b*.

Both traction outsole sections 16*b* and 16*c* have leading and trailing edges. Traction section 16*b* has leading edge 24 which has a plurality of traction elements 20 and a trailing edge 26 with a plurality of traction elements 20. Shown in cross section will be traction element 20' which is the same as traction element 20 but whose function is described in further detail. Traction section 16*c,* has leading edge 28 which has a plurality of traction elements 20 and a tailing edge 30 with a plurality of traction elements 20. Shown in cross section will be traction element 20" which is the same as traction element 20 but whose function is also described further in detail. Within all traction sections there would typically be a center area 18 that would generally have a typical non-nubbed, traction pattern molded within to facilitate traction on floors and wet surfaces.

Figure 2:
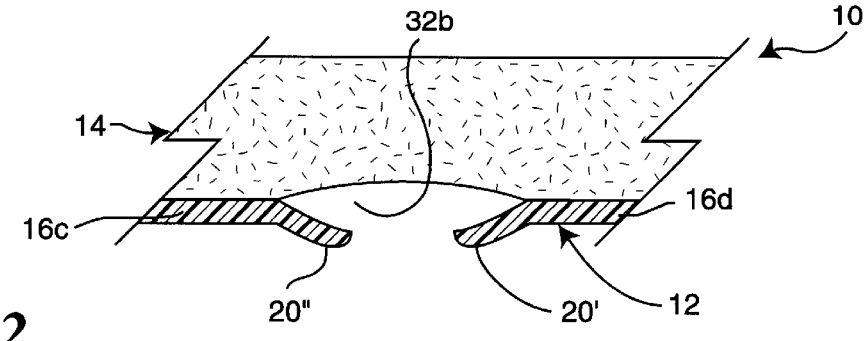
FIG. 2 is a side sectional view of an athletic shoe midsole and outsole portion incorporating a first preferred embodiment of the present invention, permanent dynamic spike outsole, in the non-compressed position, taken along line 2—2 of FIG. 1.

FIG. 2 shows a cross sectional view, taken along lines 2—2, of FIG. 1 showing traction sections 16*b* and 16*c* along with a portion of midsole 14. Within the sectional portion of midsole 14 is debris channel 32*b* Dynamic traction element 20' and dynamic traction element 20" are shown in the relaxed and uncompressed position. This position would be the position the traction elements would maintain when no pressure or force is applied.

Figure 3:
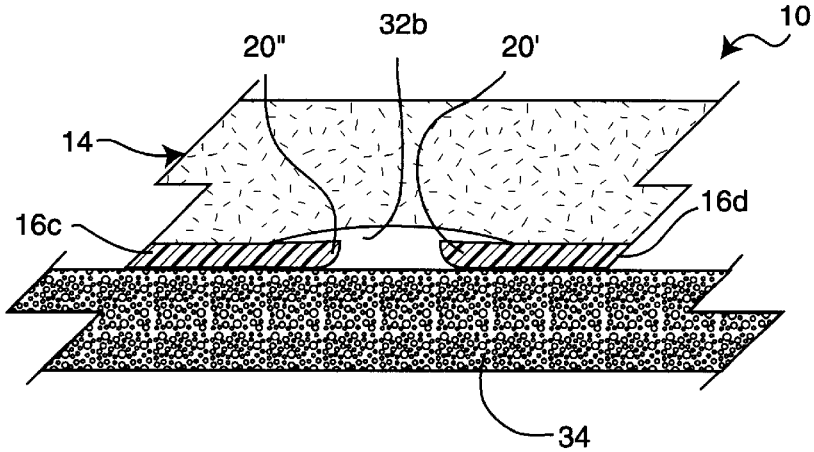
FIG. 3 is a side sectional view of an athletic shoe midsole and outsole portion incorporating a first preferred embodiment of the present invention, permanent dynamic spike outsole, in the compressed position, taken along line 2—2 of FIG. 1.

FIG. 3 shows a similar cross sectional view of the same portion of outsole 10 except in this view the traction elements are compressed as the result of walking on dense surface 34.

Figure 4:
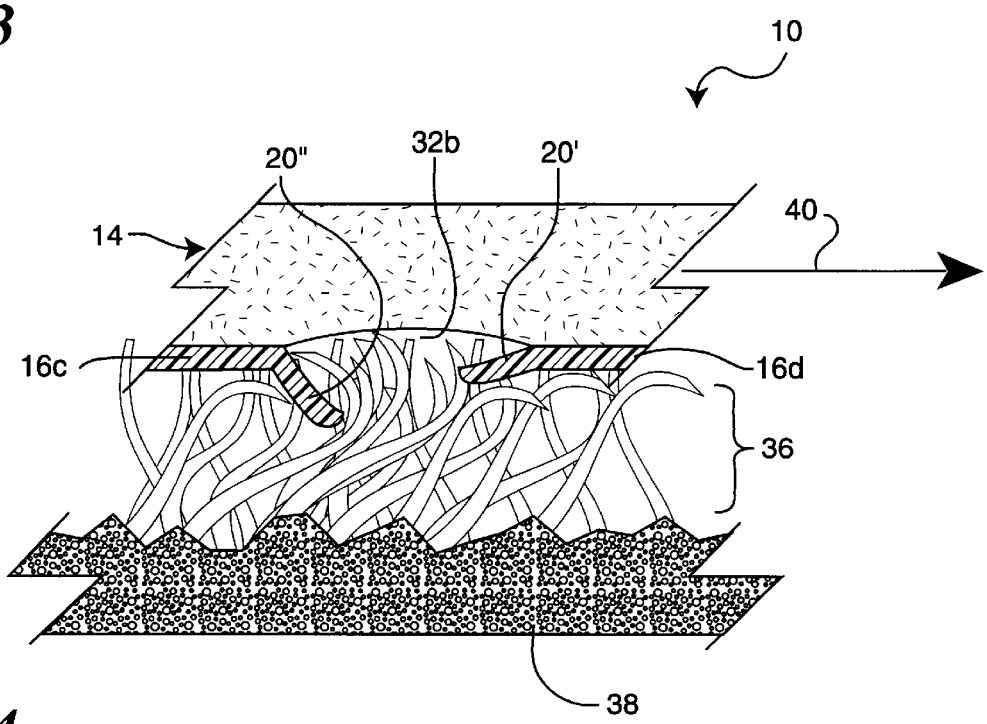
FIG. 4 is a side sectional view of an athletic shoe midsole and outsole portion incorporating a first preferred embodiment of the present invention, permanent dynamic spike outsole, in the engaged position, taken along line 2—2 of FIG. 1.

FIG. 4 shows the same portion of outsole 10 except in FIG. 4 grass has entangled with traction element 20" as a result of horizontal foot motion in the direction of arrow 40. Once a soft material such as fairway length grass 36 or soft sand such as that found in golf course bunkers, entangles within traction element 20 and horizontal movement occurs such as the foot beginning to slip, traction element 20 will flex downward and act as an arresting element, thus stopping the slippage.

Figure 5:
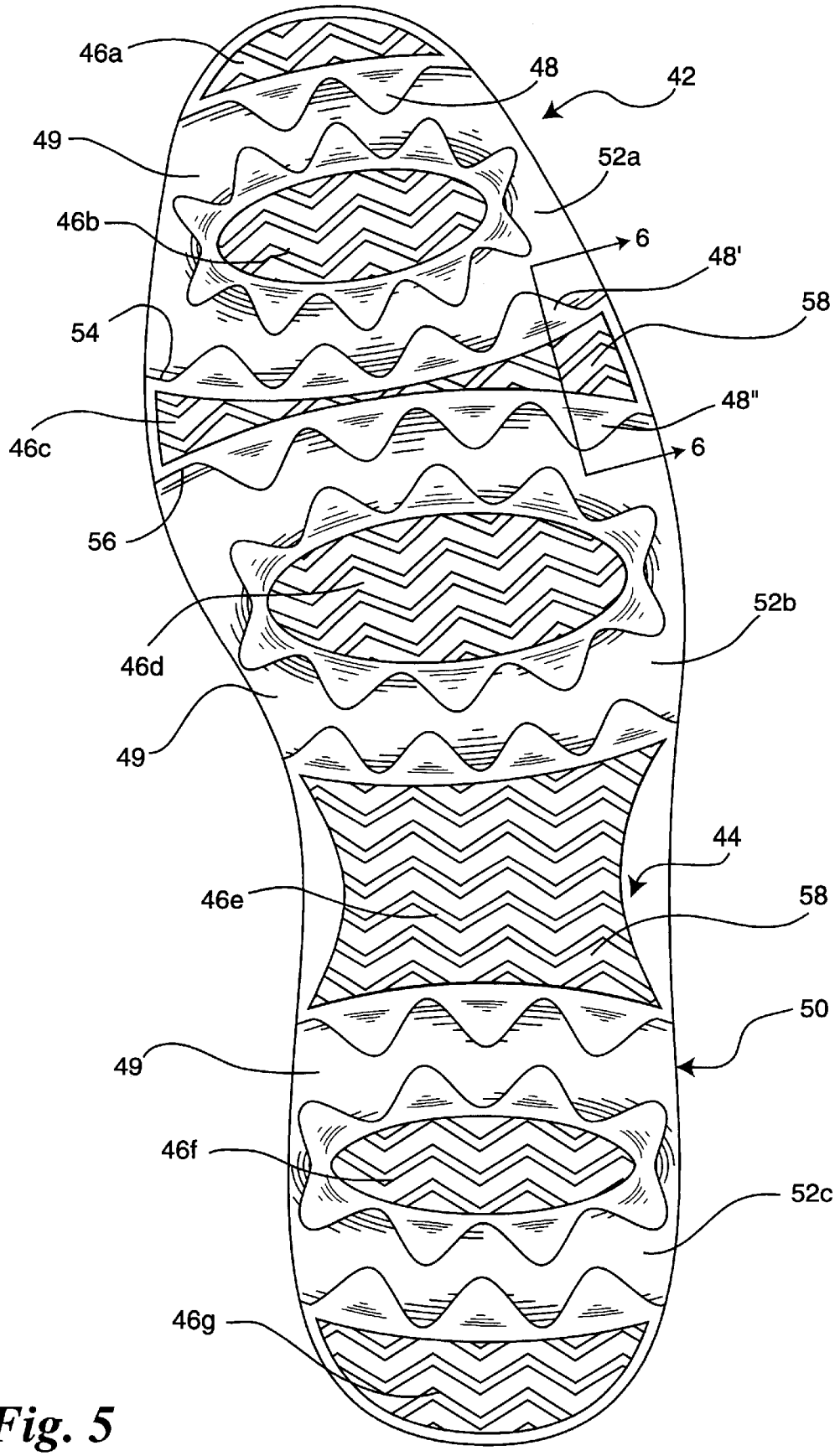
FIG. 5 is a plan view of the underside of an athletic shoe incorporating a second preferred embodiment of the present invention, permanent dynamic spike outsole.

FIG. 5 is a plan view of outsole 42 showing a second embodiment. Shown is outsole 42 along with outsole bottom surface 44 with seven traction sections 46*a* through 46*g* each of which contains a plurality of resilient dynamic traction elements 48 that are typically made of vulcanized rubber. The traction sections 46*a* through 46*g* are fixed to midsole 50 using typical adhesion means such as polyurethane adhesive. One difference with this embodiment that is not included in the first preferred embodiment is a integrally molded layer of smooth resilient thermal plastic urethane, (TPU) 49 on the bottom surface of midsole 50. This TPU layer which is molded to form at the same time as the compression molded EVA midsole is molded to form. This results in the surface areas of debris channels 52*a* through 52*c* which are molded into midsole 50, of having a glossy hard finish which will allow debris such a wet grass clippings that otherwise may clog the debris channels, to easily slide laterally out of outsole 42. Midsole 50 is an athletic shoe midsole that in this case is molded from ethyl vinyl acetate (EVA) foam. Debris channel 52*a* lies between the leading edge of traction section 46*c* and the trailing edge of traction section 46*a*. Traction section 46*b* is on a raised island portion of midsole 50 that allows all three traction sections to be on the same plane. Debris channel 52*a*a forms a moat type channel around traction section 46*b*. The two remaining island type traction sections 46*d* and 46*f* are constructed in the same manner and each has a circular debris channel. For clarity purposes in describing this second preferred embodiment of the present invention, I will limit the description to traction section 46*c* and debris channels 52*a*and 52*b*. Traction outsole section 46*c* has leading edge 54 and trailing edge 56. Integrally molded on these edges is a plurality of traction elements 48. Shown in cross section will be traction element 48' and 48" which are the same as traction element 48 but whose function is described in further detail. Within all traction sections there would typically be a center area 58 that would generally have a typical non-nubbed traction pattern molded within to facilitate traction on floors and wet surfaces.

Figure 6:
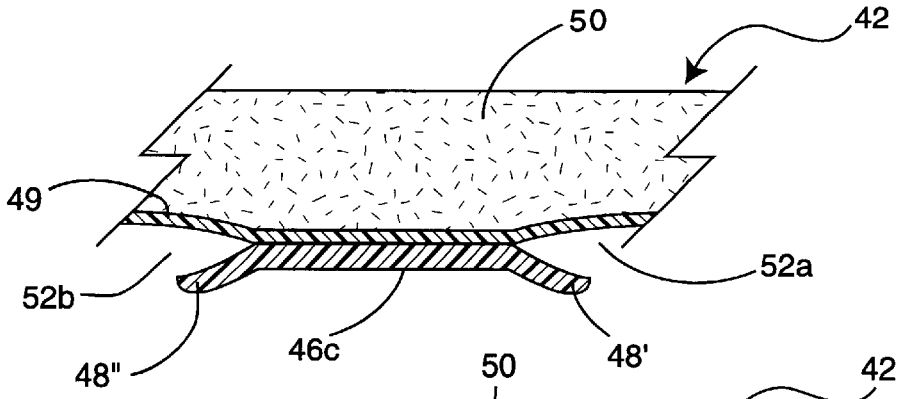
FIG. 6 is a side sectional view of an athletic shoe midsole and outsole portion incorporating a second preferred embodiment of the present invention, permanent dynamic spike outsole, in the non-compressed position, taken along line 6—6 of FIG. 5.

FIG. 6 shows a cross sectional view, taken along lines 6—6, of FIG. 5 showing traction section 46*c* along with a portion of midsole 50 and TPU layer 49. Within the sectional portion of midsole 50 are debris channels 52*a* and 52*b*. Dynamic traction element 48' and dynamic traction element 48" are shown is the relaxed and uncompressed position. This position would be the position the traction elements would maintain when no pressure or force is applied.

Figure 7:
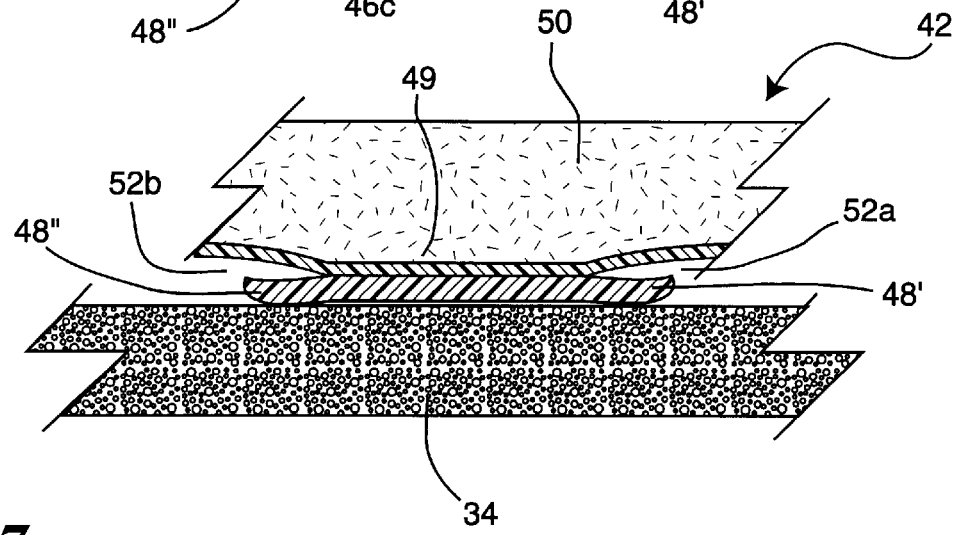
FIG. 7 is a side sectional view of an athletic shoe midsole and outsole portion incorporating a second preferred embodiment of the present invention, permanent dynamic spike outsole, in the compressed position, taken along line 6—6 of FIG. 5.

FIG. 7 shows a similar cross sectional view of the same portion of outsole 42 except in this view the traction elements are compressed as the result of walking on dense surface 34.

Figure 8:
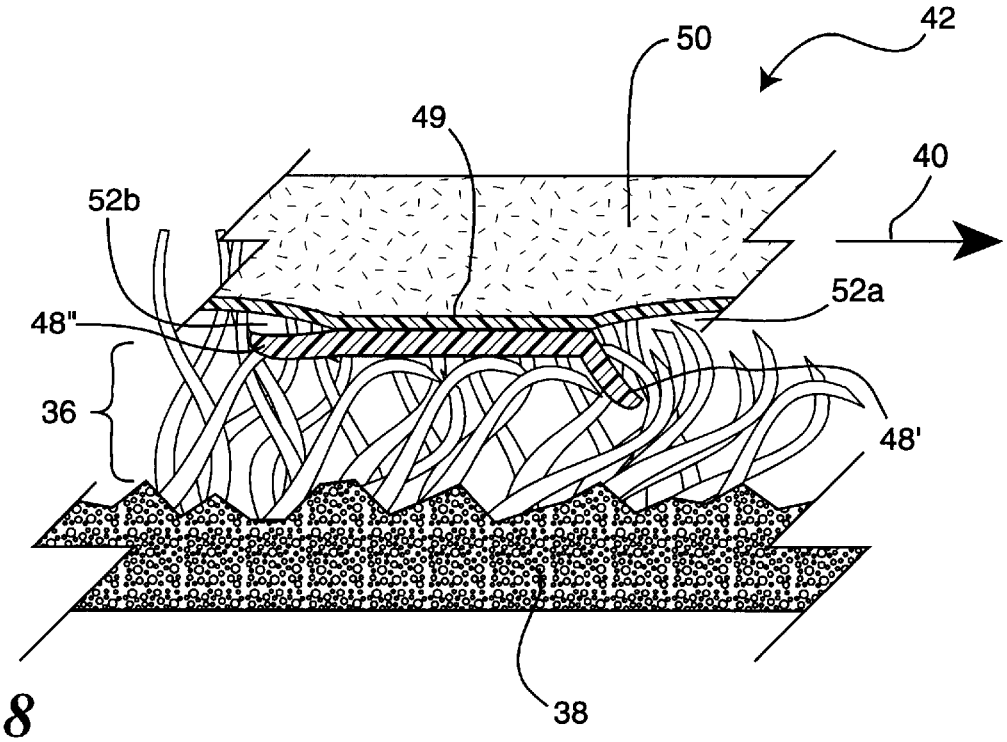
FIG. 8 is a side sectional view of an athletic shoe midsole and outsole portion incorporating a second preferred embodiment of the present invention, permanent dynamic spike outsole, in the engaged position, taken along line 6—6 of FIG. 5.

FIG. 8 shows the same portion of outsole 42 except in FIG. 8 grass has entangled with traction element 48" as a result of horizontal foot motion in the direction of arrow 40. Once a soft material such as fairway length grass 36 or soft sand such as that found in golf course bunkers, entangles within traction element 48 and horizontal movement occurs such as the foot beginning to slip in the direction of arrow 40 traction element 48 will flex downward and act as an arresting element, thus stopping the slippage.

Conclusion, Ramifications, and Scope

Accordingly, the reader will see that the dynamic permanent spike outsole features of this invention improve durability qualities and turf friendliness aspects over conventional permanent stud outsoles.

Although the description above contains many specificities, these should not be construed as limiting the scope of the invention but merely providing illustrations of some of the presently preferred embodiments of this invention.

Thus the scope of the invention should be determined by the appended claims and their legal equivalents, rather than by the examples given.

I claim:

1. A sport shoe sole comprising:

at least an outsole and a midsole;

said outsole including a plurality of traction sections having leading and trailing edges, each of said traction sections comprising:

a central area; and a plurality of dynamic traction elements extending angularly from said central area at said leading and trailing edges; and a plurality of debris channels located between said leading and trailing edges of said traction sections, wherein an inner surface of said debris channels is formed by said midsole.

2. The sport shoe sole of claim 1 wherein said central area has a tread pattern.

3. The sport shoe sole of claim 1 wherein said dynamic traction elements are integrally molded within said traction sections and extend at an angle suitable to entangle grass, thereby providing traction.

4. The sport shoe sole of claim 1 wherein at least one of said traction sections extends across a width of said sport shoe sole.

5. The sport shoe sole of claim 1 wherein at least one of said traction sections is formed on an island portion surrounded by one of said debris channels.

6. The sport shoe sole of claim 1 wherein said dynamic traction elements extend over said debris channels and are deflectable into said debris channels.

7. A sport shoe sole comprising:

at least a midsole and an outsole;

said outsole including a plurality of traction sections having leading and trailing edges, each of said traction sections comprising:

a central area; and a plurality of dynamic traction elements extending angularly from said central area at said leading and trailing edges; and a plurality of debris channels located between said leading and trailing edges of said traction sections, wherein a plastic material on said midsole forms an inner surface of said debris channels, and wherein said dynamic traction elements extend over said debris channels and are deflectable into said debris channels.

8. The sport shoe sole of claim 7 wherein said central area has a tread pattern.

9. The sport shoe sole of claim 7 wherein said dynamic traction elements are integrally molded within said traction sections and extend at an angle suitable to entangle grass thereby providing traction.

10. The sport shoe sole of claim 7 wherein at least one of said traction sections extends across a width of said sport shoe sole.

11. The sport shoe sole of claim 7 wherein at least one of said traction sections is formed on an island portion surrounded by one of said debris channels.

12. A sport shoe sole comprising:

at least a midsole and outsole;

said outsole including a plurality of traction sections, each of said traction sections comprising:

a central area; and a plurality of dynamic traction elements extending angularly from said central area; and at least one debris channel located between said traction sections, wherein an inner surface of said debris channels is formed by said midsole, and wherein said dynamic traction elements extend over said debris channel and are deflectable into said debris channel.

13. The sport shoe sole of claim 12 wherein at least one of said traction sections comprises said dynamic traction elements extending from both leading and trailing edges of said traction section.

14. The sport shoe sole of claim 12 wherein at least one of said traction sections comprises said dynamic traction elements extending from only one edge of said traction section.

15. The sport shoe sole of claim 12 wherein an inner surface of said debris channels is formed by a smooth hard slippery surface.

16. A sport shoe sole comprising:

at least a midsole and an outsole:

said outsole including a plurality of traction sections having leading and trailing edges, each of said traction sections comprising:

a central area having a non-nubbed, tread pattern molded thereon;

a plurality of dynamic traction elements extending angularly from said central area at said leading and trailing edges; and a plurality of debris channels located between said traction sections, wherein said dynamic elements extend over said debris channels and are deflectable into said debris channels.

* * * * *